US005896076A

United States Patent [19]

van Namen

[11] Patent Number: 5,896,076

[45] Date of Patent: Apr. 20, 1999

[54] FORCE ACTUATOR WITH DUAL MAGNETIC OPERATION

[76] Inventor: Frederik T. van Namen, 25570 Serena Dr., Valencia, Calif. 91355

[21] Appl. No.: 08/998,731

[22] Filed: Dec. 29, 1997

[51] Int. Cl.[6] ..... H01F 7/00

[52] U.S. Cl. ..... 335/229; 335/230; 335/231; 335/232; 335/233; 335/222; 335/251; 335/255; 335/234; 335/235

[58] Field of Search ..... 335/229–235, 335/222, 251, 255; 310/13, 14, 15

[56] References Cited

U.S. PATENT DOCUMENTS

| | | | |
|---|---|---|---|
| 2,533,187 | 12/1950 | Cataldo et al. . | |
| 2,690,529 | 9/1954 | Lindblad . | |
| 3,149,255 | 9/1964 | Trench . | |
| 4,422,060 | 12/1983 | Matsumoto et al. | 335/256 |
| 4,785,816 | 11/1988 | Dow et al. | 128/660.1 |
| 4,928,028 | 5/1990 | Leibovich | 310/23 |
| 5,434,549 | 7/1995 | Hirabayashi et al. | 335/229 |
| 5,719,451 | 2/1998 | Cook et al. | 310/12 |

*Primary Examiner*—Michael L. Gellner
*Assistant Examiner*—Tuyen T. Nguyen
*Attorney, Agent, or Firm*—J. E. McTaggart

[57] ABSTRACT

An electromagnetic active vibration actuator configuration combines two modes of operation to obtain the advantages of long stroke and linearity of voice coil type actuators and high efficiency of dual-gap solenoid type actuators. A coaxial stator shell surrounds an axially vibratable armature. Either the stator or the armature can carry one or more coils and/or permanent magnets, however usually the magnets are located on the armature for their contribution to vibrating mass. Alternate coils and alternate magnets are made opposite in polarity, the stator armature pole pieces being held symmetrically staggered relative to the stator pole pieces by end springs or flexures that allow axial vibration when AC is applied to the coils. Two different types of flux loop paths are associated with each pair of permanent magnet prominent poles: a voice-coil-effect flux loop path including two air gaps, each traversing a coil, that remain relatively constant in separation distance and permeability under vibration, and a solenoid-effect loop flux path traversing a pair of gaps in series flanking a coil prominent pole, that vary in separation distance and permeability in a complementary manner under vibration in the manner of a solenoid type actuator. These two magnetic modes operate in a cooperative additive efficient manner. Multiples of a typical magnet/coil pair can be easily tandemed using common building block component elements, typically being made to have in total an odd number of prominent poles. Wide flexibility is provided in design and manufacture to customize the performance of the actuator by manipulating the proportion of voice coil effect and solenoid effect along with the mechanical spring effect and the vibrating mass.

17 Claims, 5 Drawing Sheets

FORCE ACTUATOR WITH DUAL MAGNETIC OPERATION

FIELD OF THE INVENTION

The present invention relates to the field of active vibration control for machinery with moving parts such as aircraft, land and marine vehicles and industrial equipment; more particularly it relates to electrically-powered actuators, of the type wherein a mass is driven vibrationally in a manner to suppress vibrational disturbance.

BACKGROUND OF THE INVENTION

Active vibration actuators, like passive vibration absorbers, generally consist of two separate mass portions, one of which is typically attached to a target region for suppression of vibrational disturbance while the other is suspended so that it can vibrate in a manner to reduce the vibrational disturbance. In an active vibration actuator a suspended mass is driven to vibrate, typically electromagnetically, while in the passive vibration absorber the vibrating mass receives drive excitation only through reaction between the two masses and thus the vibrational disturbance can only be attenuated, never fully cancelled.

In an electromagnetic active vibration actuator, the two masses typically correspond to a stator assembly and a vibratable armature assembly, either or both of which can include a coil powered from an AC (alternating current) electrical source and/or a permanent magnet system; a suspension system between the two mass portions allows reciprocal vibration, which takes place at the frequency of the applied AC. Generally the stator will be solidly attached to a machine, engine frame or other body subject to vibrational disturbance, while the armature is vibratably suspended and is driven to vibrate, relative to the stator, at a predetermined frequency, typically that of the vibrational disturbance, the phase and amplitude being optimized to produce a counter-reaction from the driven vibrating armature mass that act in a manner to suppress the vibrational disturbance.

Another version of active vibration actuator delivers output via a moving shaft, typically driven axially; the main body of the actuator unit is attached solidly to a massive body such as a machine frame, and the output shaft is attached to the part or region in which vibrational disturbance is to be suppressed by transmitting a counteracting vibrational force via the output shaft.

Theoretically, a non-feedback active vibration control actuator could be fine-tuned and adjusted in manner to completely cancel disturbing vibration, however in order to track any change that may take place in the parameters of the vibration, the active vibration actuator is usually placed under control of a feedback loop that responds to sensed vibration.

Typical structure of an active vibration control actuator is coaxial, with the stator assembly including a soft steel tubular shell housing surrounding an axially-vibratable armature assembly. The stator assembly and/or the armature assembly can include any of three basic elements: permanent magnets, coils and/or low-reluctance path segments such as yokes, cores, pole pieces, etc. made from ferromagnetic material such as soft steel or iron. Such magnetic material will be referred to henceforth herein simply as iron.

Such actuators are motivated via magnetic flux paths that can each be represented by a loop that typically includes at least a coil, a permanent magnet, one or more iron segments and one or more relatively small air gaps.

This mass is motivated electromagnetically from AC in the coil in a manner to cause it to vibrate at frequencies, amplitudes and phase angles that optimally suppress the disturbing vibration: this may be accomplished by an electronic feedback loop and control system that senses vibration both at its source and in the disturbed region, and automatically adjusts the frequencies, amplitudes and phase angles to minimize the disturbing vibration.

Typically the vibrating mass is supported by end spring suspension members or flexures which act to hold it centered when in a quiescent condition, i.e. with no current applied to the coils. The mechanical spring is characterized by a spring modulus (sometimes referred to as spring constant or spring rate) defined as force/deflection distance. The combination of the spring modulus and the vibrating armature mass determines a frequency of natural vibration resonance. Current in the coil(s) of the actuator generally acts in a manner of a negative spring modulus to override the force of the mechanical spring suspension and drive the armature to vibrate at the driven frequency; however, at frequencies other than the natural resonant frequency, the actuator may operate inefficiently due to improper magneto-mechanical coupling.

Overall electrical power efficiency, i.e. mechanical output energy versus electrical driving power, is important in an active vibration control actuator; the different configurations of the basic elements found in known art represent different approaches seeking to optimize the important overall parameters such as efficiency, performance, reliability and ease of manufacture. A key factor is the natural mass-spring resonance and the extent to which this can be altered or overpowered by the electromagnetic drive system.

Active electromagnetic vibration control actuators of known art can be categorized in two general types: voice coil type and solenoid type.

The voice coil type of actuator gets its name from well known loudspeaker structure wherein a tubular voice coil assembly, typically a single layer of wire on a vibratable voice coil form, is constrained concentrically by suspension means and centered in an annular magnetized gap of constant separation distance and constant permeability formed in a flux path loop that includes a stationary permanent magnet. When an electrical current is applied to the voice coil, a force equal to the cross-product of current and magnetic flux density is exerted on the voice coil in a direction defined by the classical Right Hand Rule of electromagnetics, driving the voice coil in the direction of the force to a displacement that is constrained by the suspension springs.

Typically the loudspeaker voice coil is made to extend well beyond the region of the magnetic gap symmetrically in both directions, so that at any instant, as it travels back and forth, only that portion of the voice coil within the magnetic gap interacts directly with the concentrated magnetic field to produce the driving force. Alternatively the voice coil may be made much shorter than the extent of the magnetic gap so that, when vibrating to its limit of travel, it remains entirely within the magnetic gap. In either case, in the conventional loudspeaker voice coil driver, there is an inherent sacrifice of efficiency due to this partial coil-to-magnet coupling, in a tradeoff to gain linearity and long stroke travel capability.

In applying the voice coil principle to active vibration actuators, generally the fixed portion or stator is made to include a tubular iron shell housing. The voice coil may be made multi-layer, may be associated with nearby iron members for concentrating flux and may be made fixed rather than moving. The typical fixed central magnetic core pole piece of the loudspeaker may be replaced by a movable central armature suspended in a manner to be vibratable axially, usually constrained by end springs, thus constituting a vibratable mass.

In a moving-coil version of a voice-coil type actuator, permanent magnets may be attached immediately inside the fixed iron outer shell stator assembly surrounding a vibratable armature which carries multi-layer coils wound on a iron core formed with associated iron pole-piece prominences, and which thus constitutes the vibratable mass.

Conversely, in a moving-magnet version of a voice-coil type actuator, multi-layer coils may be attached immediately inside the iron outer shell stator assembly, surrounding the vibratable armature which carries permanent magnets and associated iron pole-piece prominences, and which thus constitutes the vibratable mass.

Typically, in both the moving-coil and the moving-magnet versions of voice-coil type active vibration actuators, a concentric central moving armature is configured with at least two magnetic prominences formed by short cylinders whose circumferences each form an annular magnetic air gap with the iron shell. In typical cross-section, the armature prominences and the stator prominences are made to both face a common reference line from opposite sides so that the armature assembly can be easily inserted into and withdrawn from the stator assembly.

Electromagnetic active vibration actuators can be classified into two general types: voice-coil type and solenoid type. Both types may have a coaxial electromagnetic structure wherein a stator portion and an axially-vibratable armature are linked together by a magnetic flux loop path that includes at least one permanent magnet, an AC-driven coil, and at least one magnetic air gap.

The voice coil type operates on the principle of force acting on wire in a coil in a magnetic field, the force acting in a direction perpendicular to the direction of current and perpendicular to the magnetic field, according to the Right Hand Rule. The magnetic field is concentrated in an air gap (or gaps) having a separation distance and permeability that remain substantially constant in operation as the armature travels axially. The armature, like the voice coil of a loudspeaker, requires some form of spring suspension to establish a normal stabilized centered position, otherwise the armature would free-float axially and drift off center.

In contradistinction, the solenoid type actuator operates generally on the principle of attraction between movable magnetized bodies; more particularly a magnetic force acts on a movable armature through a magnetized air gap whose separation distance varies with armature displacement and thus the permeability is incremental, the armature tending to move in a direction that intensifies the magnetic flux in the air gap.

A simple solenoid without any permanent magnet typically attracts an armature from an offset large-gap position to a centered small-gap position or an end-of-travel closed-gap position in response to DC of either polarity in the coil; thus, with AC applied to the coil, any vibration response would be very inefficient and at a doubled frequency. For use as a vibration control actuator, the solenoid is modified to be magnetically biased, e.g. by the addition of a pair of permanent magnets (or one permanent magnet and a second coil) to form a dual-gap solenoid type actuator.

When the coil of such a dual-gap solenoid type actuator is AC-driven, thus vibrating the armature, there is a recurring redistribution of magnetic flux in each pair of gaps that sets up eddy currents in the pole pieces. Therefore, while the dual-gap solenoid type provides good efficiency, especially in applications where the armature may be allowed to travel to an end limit where the gap closes, in active vibration applications the dual-gap solenoid type generally suffers the disadvantages of complexity of structure and the need for tight tolerances between parts. Another disadvantage is the limitation of the amplitude of travel of the armature, limiting the use of this type of actuator to high frequencies. At such high frequencies, the iron pole pieces may require slotting or lamination to avoid excessive eddy current losses due to the magnetic flux variations. Yet another disadvantage is the small mass of the armature, making it usually necessary to use the exterior mass of the coil and magnet structure as the inertial mass. Also, while a voice coil type actuator can be readily extended by adding more voice-coils and corresponding gaps, the dual-gap solenoid type actuator can be extended only by adding one or more complete similar actuator units in a tandem manner.

DISCUSSION OF KNOWN ART

In FIG. 1, a cross-sectional representation, shows an example of a moving-magnet version of a voice coil type actuator 10A illustrating in basic form the principles taught by U.S. Pat. No. 5,231,336 disclosing an Actuator for Active Vibration Control and by U.S. Pat. No. 5,231,337 disclosing a Vibratory Compressor-Actuator, both by the present inventor.

A stator portion is formed by two voice coils C1 and C2 located side by side, connected in opposite polarity, and fastened immediately inside a tubular iron shell 12 fitted with end plates E1 and E2.

A cylindrical central vibratable armature portion contains a permanent magnet M, magnetized as shown (N, S) with opposite magnetic poles at opposite parallel end planes fitted with cylindrical iron prominent pole pieces P1 and P2. These, facing iron shell 12, form a corresponding pair of annular air gaps through which a magnetic flux loop path 14 traverses corresponding central portions of voice coils C1 and C2. The moving armature is vibratably supported on a central rod 16 such in an axial direction only, by sliding along rod 16, as indicated by the double arrow. The armature is constrained by a pair of end springs S1 and S2, which, bearing against end plates E1 and E2, also act as elastic end stops or bumpers that limit the axial travel range of the armature.

When AC is applied to coils C1 and C2, the portion of each voice coil within the corresponding magnetic gap receives a Right Hand Rule force as described above; the resulting stator-to-armature forces at the two gaps are additive due to the opposite coil polarities, thus the armature is caused to vibrate axially as indicated by the double arrow. The two magnetic air gaps, moving axially along with the vibrating armature, remain substantially constant in separation distance and permeability.

FIG. 2 illustrates a solenoid type of actuator of known art, wherein the stator portion includes a continuous coil winding C located immediately inside an iron shell 12A and two annular permanent magnets M1 and M2 located inside coil winding C. The magnets are oppositely polarized so that like poles each face an annular iron ring R, i.e. NSRSN as indicated, or alternatively SNRNS. Ring R forms a prominent pole piece facing inwardly toward a reciprocating cylindrical iron armature core 18 fitted with a central support shaft 20 that protrudes through sleeve bearings formed in iron end plates E1 and E2, suspending core 18 with freedom to vibrate axially and to transmit vibration output to an external object via an extending end of shaft 20.

Magnets M1 and M2 set up magnetic flux paths 22A and 22B respectively that loop through the two corresponding opposite ends of armature 18 as shown. In the central position shown, with zero current in coil winding C, the magnet flux paths 22A and 22B tend to balance and in effect cancel each other with regard to driving forces applied to armature. This condition is a critical unstable balance in the absence of end springs to hold the core 18 centered, since core 18 will be magnetically attracted to either end plate E1 or E2 increasingly as it moves off center. Thus, without end springs, the solenoid as shown would be bistable; therefore in most cases some form of spring suspension is required to stabilize the armature in the center position.

When electrical current is applied to the coil winding 10C, an additional flux path 22C is set up as shown in the dashed line, looping through the iron shell 12A, the iron end plates E1 and E2 and the core 18 as shown. The magnetic flux from the coil, having the direction shown by the arrow heads, aids flux path 22A and opposes path 22B, thus urging the core 18 toward the left due to the increased magnetic attraction to iron end plate E1. Conversely, current in the opposite direction in coil winding C will urge the core 18 toward the right. Thus AC in the coil will cause the armature to vibrate reciprocally at the frequency of the AC.

U.S. Pat. No. 4,641,072 to Cummins discloses an Electro-Mechanical Actuator of the solenoid type wherein the moving armature includes a portion located external to the stator shell, containing coils, and a portion enclosed by the stator shell containing a pair of permanent magnets.

U.S. Pat. No. 4,710,656 to Studer discloses a Spring Neutralized Magnetic Vibration Isolater providing an electronically-controllable driven system with a single degree of freedom suspension element exhibiting substantially zero natural frequency of vibration. Non-resonance is obtained through a viscous damping effect from a combination of a spring, a mass, two permanent magnet circuits, and an electromagnetic coil driving a shunting/shorting armature in a solenoid mode.

OBJECTS OF THE INVENTION

It is a primary object of the present invention to provide improved efficiency in an active vibration control actuator by combining features of the voice coil type and of the solenoid type in a manner to better overcome the disadvantages of each.

It is a further object to utilize pairs of magnetic gaps in a manner that magnetic flux variations in each gap of a pair are made to be complementary to each other and thus additive with regard to output force, due to the differential in the pair.

It is a further object to utilize a plurality of magnets in a manner to cause the same forces to act on all magnets in the same direction, so that when the current reverses, all the forces are made to reverse.

It is an object of the invention to provide the designer and manufacturer of the actuator with greatly increased design control over the output force as a function of frequency (spectrum) by enabling the forces and damping of each of the two types (voice-coil and solenoid) to be balanced against each other through a selection of standard building block components including properly chosen internal suspension springs.

SUMMARY OF THE INVENTION

The abovementioned objects have been accomplished by the present invention of an electromagnetic active vibration actuator configuration that combines features of actuators of the voice coil type with features of the solenoid type. A coaxial stator shell assembly with one or more identical short annular prominences arranged in a row extending inwardly surrounds an axially vibratable armature with one or more corresponding short cylindrical prominences arranged in a row extending outwardly, with either the stator or the armature having one more prominence than the other. In the quiescent central position of the armature, the armature prominences and the stator prominences are constrained midway relative to each other by end springs suspending the armature in the stator.

In a first embodiment, at least two coils are located in the stator, which is made to have at least one central prominence between a pair of adjacent coils, and at least one permanent magnet is located in the armature, flanked by a pair of prominences constituting magnetic poles. In a second embodiment, permanent magnets are located between the stator prominences and coils are wound on a common armature core and located between prominences extending outwardly from the core. Adjacent coils and adjacent magnets are always oppositely polarized.

In either embodiment, there are two distinct operational magnetic flux loop paths associated with each permanent magnet prominence: a voice-coil-effect flux loop path extending directly through the mid region of a coil into the opposite main magnetic element (iron shell or core) forming an air gap that has a substantially constant separation distance and permeability under vibration, and a solenoid-effect flux loop path that extends from a first magnet pole, through a first air gap including a first end of coil, through a coil magnetic prominence, then through a second air gap including a second end of the coil to the second magnet pole, such that under vibration the two gaps vary in separation distance and permeability in a complementary manner. The solenoid effect can be intensified by including iron ring end prominences in the stator and/or by utilizing end plates made of iron material thus setting up a further flux loop. Conversely the solenoid effect can be downsized by omitting stator end prominences and/or iron end plates, or even omitting some of the stator prominences in a multi-section actuator.

Thus the voice coil effect and the solenoid effect act cooperatively in applying force to the armature in an axial direction that depends on the direction of current in the coils, in combination providing improved efficiency in driven vibration of the armature in response to AC power applied to the coils.

Furthermore the solenoid effect created by the structure of the magnet system in this invention acts in a manner to introduce a negative spring modulus that opposes the positive spring modulus of the mechanical spring suspension in determining the system spring modulus and thus the natural resonance frequency.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
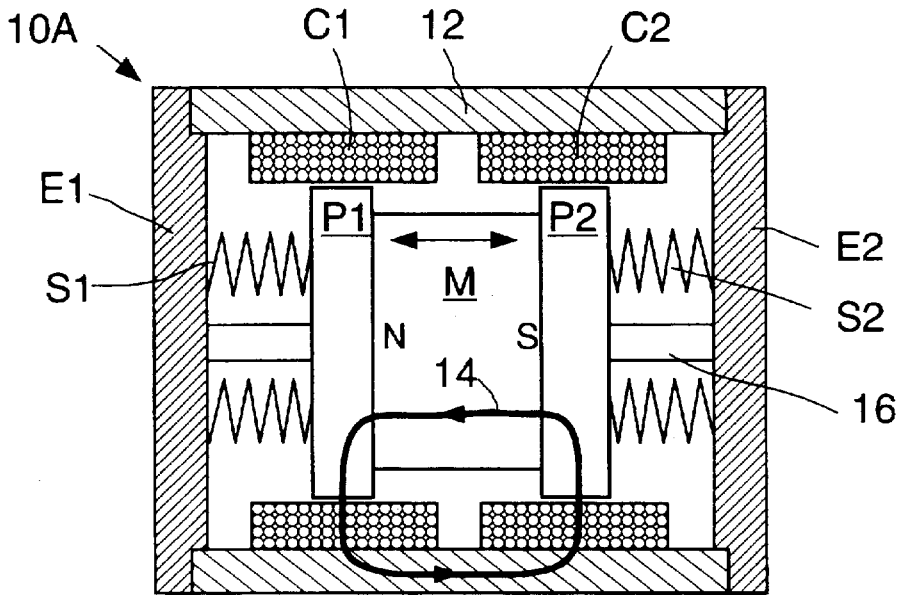
FIG. 1 Prior art
FIG. 1 is a cross-sectional representation of an active vibration actuator of known art of the voice coil type in a simple basic form having a single permanent magnet armature and a dual voice coil stator.
Figure 2:
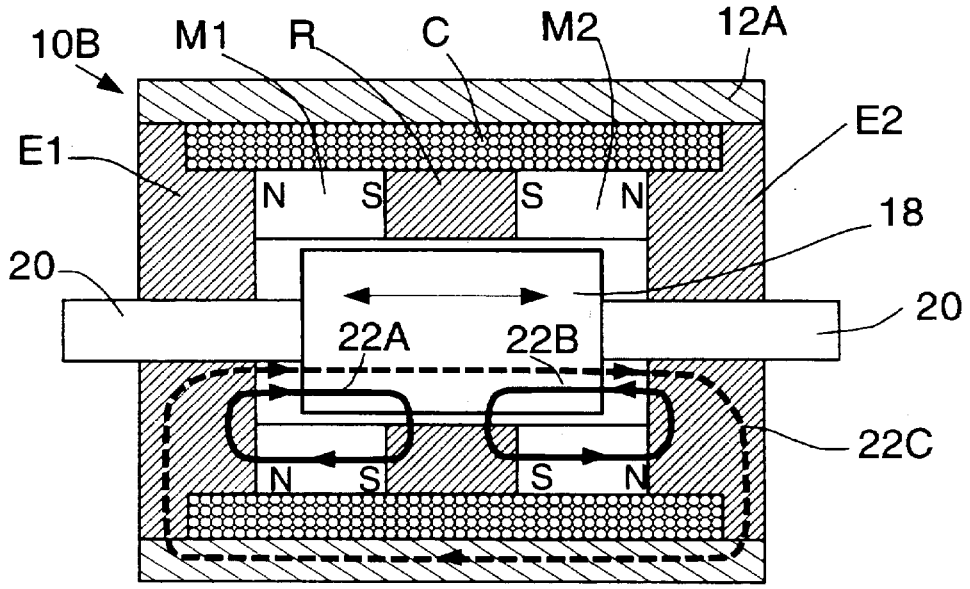
FIG. 2 Prior art
FIG. 2 is a cross-sectional representation of an active vibration actuator of known art of the dual-gap solenoid type having a single iron core armature and a stator having two permanent magnets and a coil.

FIGS. 1 and 2 have been described above.

Figure 3:
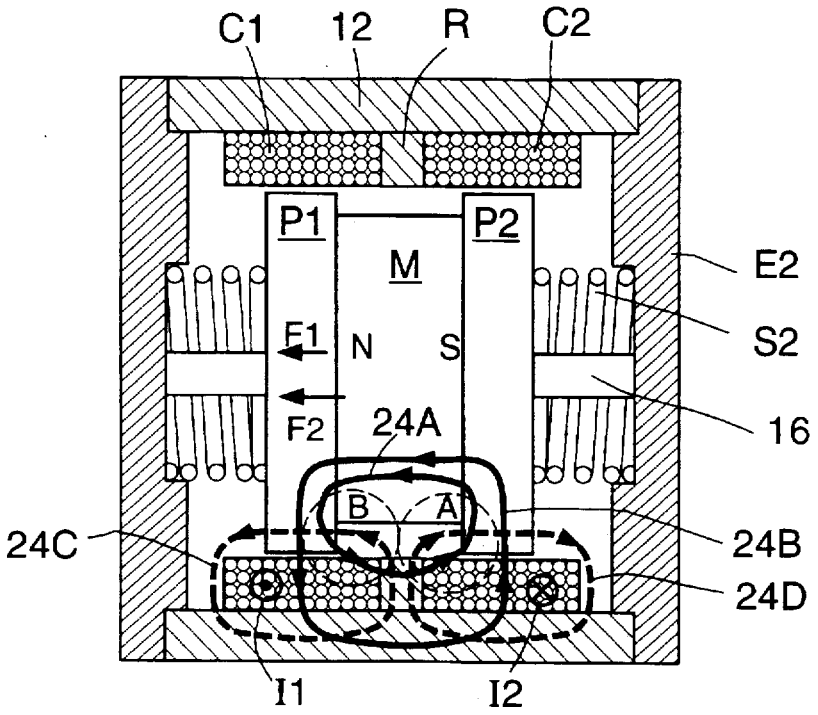
FIG. 3 is a cross-sectional representation of an active vibration actuator of the present invention in its simplest basic embodiment with a dual voice coil stator and a moving permanent magnet armature.

FIG. 3 is a cross-sectional representation of a basic moving-magnet embodiment of a moving-magnet active vibration actuator of the present invention, shown in its simplest form for ease of understanding. An iron shell 12 is closed at the ends by end plates E1 and E2 which can be made from either magnetic or non-magnetic material, as a design option that alters the magnetic configuration and operation of the actuator.

The stator assembly contains two voice coils C1 and C2, immediately inside shell 12, connected in opposite polarity as indicated by the current symbols I1 (⊙) and I2 (X). The coils are separated by an annular iron ring R contacting the inside wall of shell 12 and facing inwardly to serve as a prominent electromagnetic pole piece.

The armature assembly includes an annular permanent magnet M, magnetized to provide poles at opposite parallel end surfaces as indicated N and S. These surfaces interface with short cylindrical iron pole pieces P1 and P2 which each set up a pair of magnetic air gaps with shell 12, each gap containing a bundle of concentrated magnetic flux lines, one gap traversing a central portion of coil C1 and the other gap traversing a central portion of coil C2.

The armature assembly is movable in an axial direction by sliding on a central shaft 16 which is fastened to end plates E1 and E2. The armature is constrained in a centered position by springs S1 and S2 which may be selected for spring modulus to provide a desired natural resonant frequency of the vibrating mass, i.e. the armature.

Permanent magnet M sets up two main magnetic flux loop paths: a solenoid-effect path 24A mainly through ring R and magnet poles P1 and P2, including air gaps on either side of ring R that vary inversely to each other in separation distance and permeability when the armature moves axially, and a voice-coil-effect path 24B horizontally through shell 12 and vertically through air gaps of substantially constant separation distance and permeability containing the central portion of coils C1 and C2.

In the absence of current in the coils C1 and C2, the flux paths from the magnets tend to balance overall and in effect cancel each other, thus there is virtually no axial driving force applied to the armature from either voice coil or solenoid effect when it is located in the central position shown, where the permanent magnet forces on the armature are balanced. However the centering forces provided by end springs S1 and S2 are necessary to overcome the negative spring effect of the solenoid mode caused by a magnetic attraction between ring R and the closer one (P1 or P2) of the two poles, whenever the armature becomes offset from center.

When electrical current is applied to the coils C1 and C2, flux paths 24C and 24D (dashed lines) are set up having polarity as indicated by the arrow heads due to the direction of current in the coils C1 and C2. Combining flux paths 24C and 24D from coil C1 with the magnet solenoid-effect flux path 24A, it is seen from the direction of the arrow heads that paths 24A and 24D are additive in region A, while the paths 24A and 24C are subtractive in region B: the net effect of this unbalance is a solenoid-effect force F1 acting axially to move the armature to the left as indicated.

The voice-coil-effect flux path 24B traversing vertically through coils C1 and C2 reacts with the current in the coils to create a voice-coil-effect axial force on each coil, and thus a reaction on the stator portion, that exerts a voice-coil-effect reaction force F2 on the armature in the same axial direction as the solenoid-effect force F1, thus the solenoid effect and the voice coil effect combine additively to drive the actuator.

When the coil current is reversed, all the forces reverse accordingly, driving the armature in the opposite direction, i.e. to the right. Thus the armature can be driven to vibrate at the frequency and amplitude of AC applied to the coils.

From a design viewpoint, the force output spectrum of the actuator can be manipulated in a desired manner in design by a judicial balance between the voice coil effect and the solenoid effect; also the efficiency can be optimized through careful selection of materials in the magnetic circuit, the dimensions of the coils and the suspension characteristics.

Figure 4:
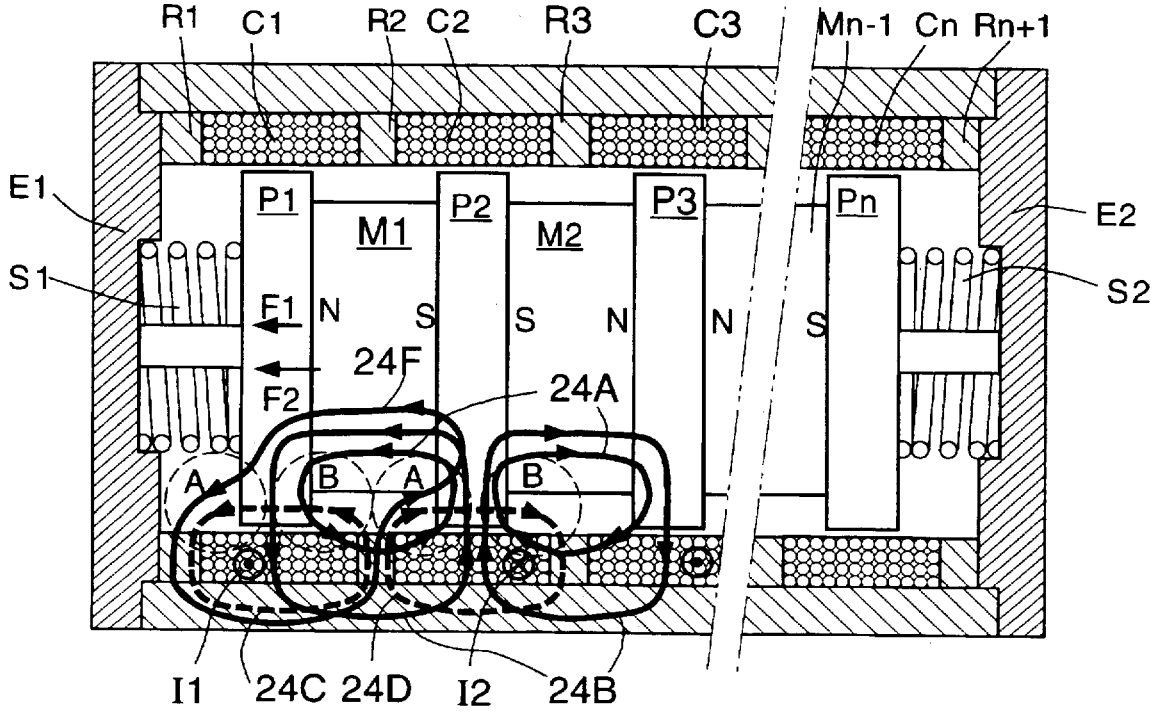
FIG. 4 is a cross-sectional representation of an active vibration actuator of the present invention in a generalized multi-section moving-magnet embodiment based on an expansion of the actuator of FIG. 3, utilizing the same basic elements.

FIG. 4 is a cross-sectional representation of an active vibration actuator of the present invention in a generalized moving-magnet embodiment illustrating how the basic embodiment of FIG. 3 can be expanded to any multiple by the addition of coils, magnets and rings. Coils C1 . . . Cn are seen to alternate in polarity as indicated by the current symbols I1 (⊙) and I2 (X) and are seen to fill corresponding adjacent annular channels separated by rings R2, R3, etc . . . of magnetically permeable material. Functionally, these channels could be formed integrally as part of iron shell 12, e.g. by casting or machining; however, for practical reasons to facilitate assembly, the channels are formed by making the rings R2, R3 . . . as separate parts that are inserted into shell 12 along with coils C1 . . . Cn.

End rings R1 and Rn+1 are an optional design choice in any single or multiple configuration; for example, these could be added to the single magnet embodiment of FIG. 3 at the spaces seen at the outer edges of coils C1 and C2. Adding end rings strengthens the solenoid effect and thus alters the proportions of the voice coil and the solenoid effects in the overall performance characteristic. The option of omitting or including end rings, along with the option of magnetic or non-magnetic material in end plates E1 and E2, provide four steps of such proportioning available for design/manufacturing customizing; further modification is available through selection of springs S1 and S2.

As indicated in FIG. 4, for n coils there will be n−1 magnets, n armature pole pieces. As with a single unit there can be n+1 stator rings (with end rings) or n−1 stator rings (no end rings), furthermore, in a multiple unit one or more additional rings could be omitted as a design/manufacturing option: if all rings were omitted, the actuator would operate entirely in a voice-coil mode as in FIG. 1.

The magnetic influence of end rings is shown by the magnetic flux paths shown on magnet M1: in addition to solenoid-effect path 24A and voice-coil-effect path 24B, as described above in connection with FIG. 3, there is an additional solenoid-effect path 24E extending from magnet pole P1 to the left, passing through ring R1 into shell 12, through ring R2 to pole P2 and thence returning to pole P1 through magnet M1. It is seen that when current is applied to the coils, the total flux in regions A increases due to addition while the total flux in regions B decreases due to subtraction, thus contributing further to the solenoid-effect force F1 as part of the overall force F1+F2 moving the armature to the left. When end plate E1 is made of iron, there will be an additional path similar to path 24E extending further to the left and passing through a portion of the end plate El, thus contributing further to the solenoid-effect. For long armature strokes, associated with low frequencies and high armature mass, the end plates E1 and E2 may be made of non-magnetic material. For short strokes, the end plates can be made of iron and made to conduct magnetic flux sufficiently so that the end rings could be eliminated. For low magnet spring modulus, the designer has the option of omitting one or more of the iron rings.

Flux paths such as path 24E and mirror images thereof are also in effect around each of the (non-end) iron rings R2 . . . Rn.

As with the single-magnet embodiment of FIG. 3, end springs S1 and S2 may be selected for spring modulus and its determining effect on the natural resonant frequency of the vibrating armature, along with the mass of the armature which will depend on n−1, the number of magnets.

Figure 5:
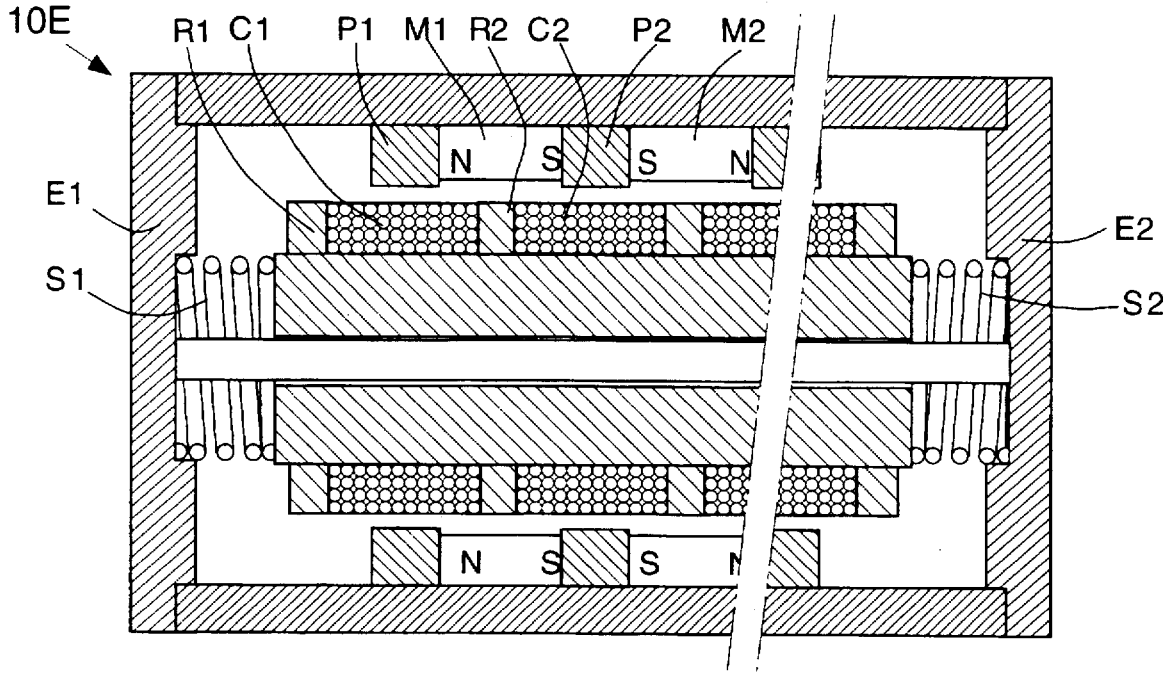
FIG. 5 is a cross-sectional representation of an active vibration actuator of the present invention in a generalized alternative multi-section moving-coil embodiment.

FIG. 5 shows an alternative generalized multiple embodiment wherein n coils with n+1 prominent poles are incorporated in the armature and n−1 annular permanent magnets with n prominent poles are located inside the stator shell, surrounding the armature. In simplest form there could be a single coil and two permanent magnets.

Figure 6:
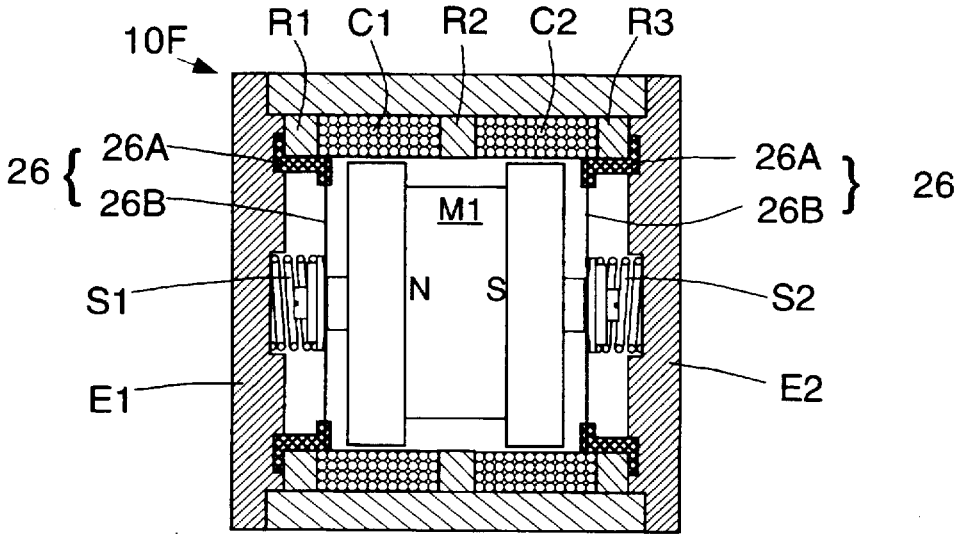
FIG. 6 depicts a basic embodiment similar to that shown in FIG. 3 but with the addition of two stator end rings and a pair of armature suspension flexure assemblies.

FIG. 6 depicts a variation of the basic embodiment shown in FIG. 3 with end rings R1 and R3 added and with the armature suspended at both ends by special flexure assemblies 26, which along with optional coil springs S1 and S2, also act as an elastic end stop or bumper. Flexure assemblies 26 each consist of a resilient surround support 26A into which are molded one or more, typically two spring strips 26B spanning diametrically across surround support 26A. Each flexure assembly 26 is secured to the armature by a corresponding screw 28 traversing spring strips 26B and threaded into the corresponding end of armature shaft 16 as indicated by the dashed hidden outlines.

Figure 7:
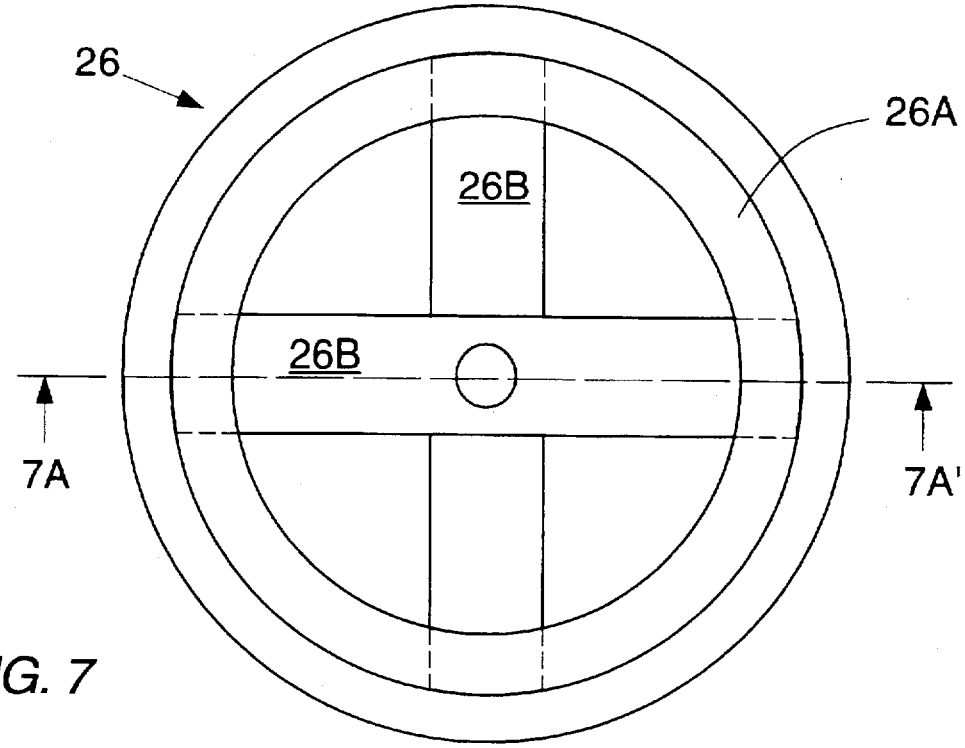
FIG. 7 is an end view of a flexure assembly as used in the embodiment of FIG. 6.

FIG. 7 is a an end view of a flexure assembly 26 shown in FIG. 6, formed from a pair of similar cross-straps 26B of spring steel each with both ends molded into surround support 26A which is molded from resilient material such as high temperature silicon rubber which may be reinforced with Kevlar fiber. An outer flange of support 26A is constrained in an annular channel formed or machined in the corresponding end plate E1, E2 (refer to FIG. 6).

Figure 7A:
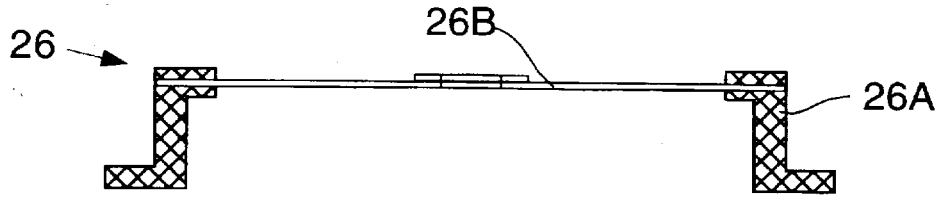
FIG. 7A is a central cross-sectional view of the flexure assembly of FIG. 7 with the armature in a central quiescent location.

FIG. 7A is a cross-sectional view of flexure assembly 26 taken through axis 7A—7A' of FIG. 7. Cross strap 26B is shown in its normal unbent state, corresponding to the armature at rest at the center of its travel range. The ends of cross-straps 26B are embedded integrally in surround support 26A, typically in a molding process.

Figure 7B:
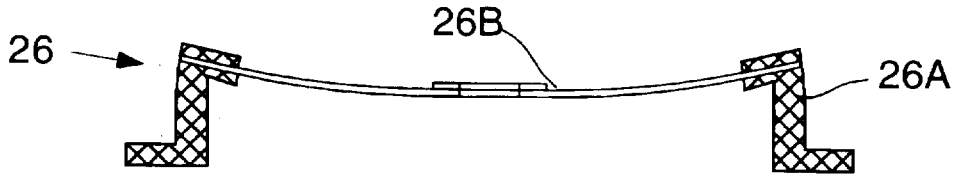
FIGS. 7B and 7C show cross-sections of a flexure assembly as in FIG. 7A with the spring strips bending in opposite directions corresponding to axial offsets of the armature.
Figure 7C:
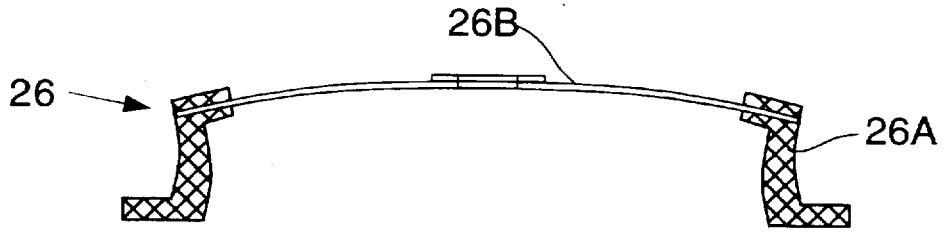

FIGS. 7B and 7C show the cross-section of flexure assembly 26 of FIG. 7A with the cross strap 26B bending in two opposite directions corresponding to axial offsets of the armature at the two opposite extremes of its travel range when vibrating. The resilience of surround support 26A accommodates changes in the length of the cross-straps 26B due to arching.

Figure 8:
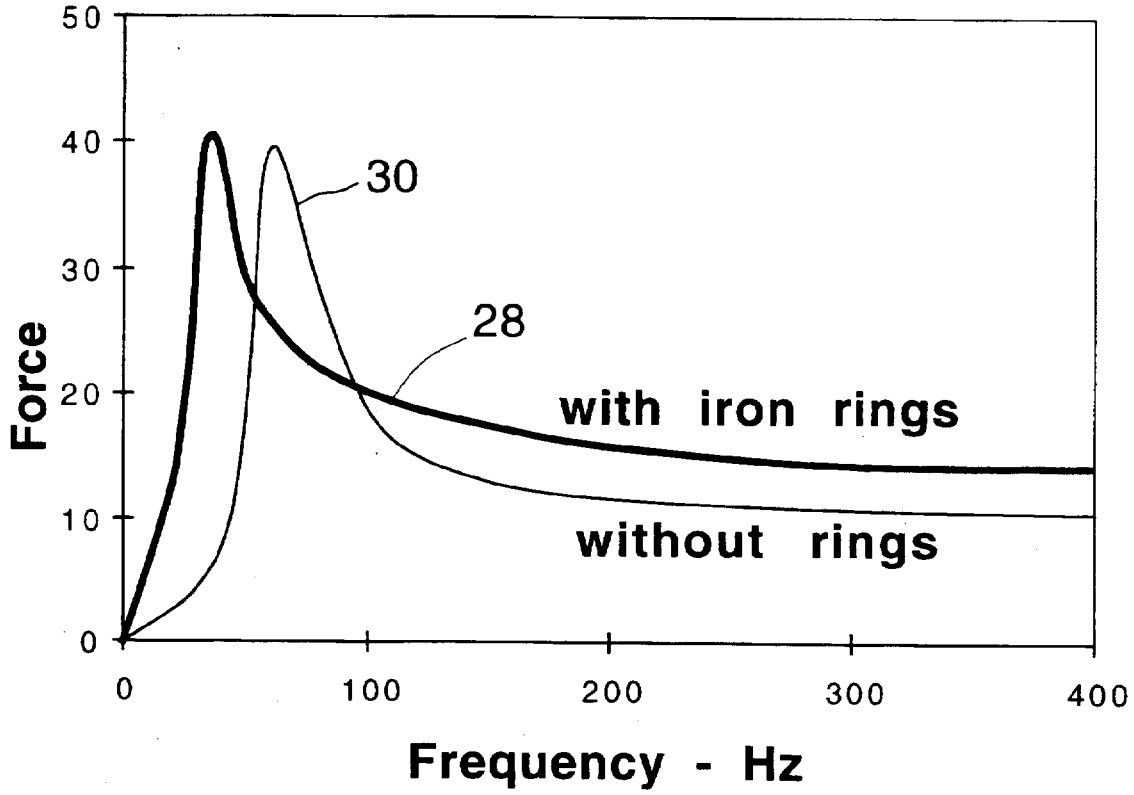
FIG. 8 is a graph showing force generated by an actuator as a function of frequency for the present invention compared to a strictly voice coil type actuator without internal annular iron stator rings.

FIG. 8 shows graphically the effect of the iron stator rings (R1 . . . Rn+1, FIG. 4) that are key elements of the present invention. In the graph showing force generated by an actuator as a function of frequency (spectrum) the present invention, curve 28 shows the response with the iron rings in place, compared to curve 30 with the iron rings removed so as to cause the actuator to operate entirely in a voice coil mode as in FIG. 1.

The predominant peak seen in both curves is due to mechanical spring-mass resonance. Curve 28 shows two important advantages over curve 30; a lower resonant frequency, and higher operating efficiency and flatter response throughout most of the useful frequency spectrum.

The design freedom enabled by the present invention allows the resonant peak to be shifted as low as desired in the spectrum, even to zero or into the negative frequency domain, thus facilitating design for optimal operation throughout the desired frequency spectrum.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An electromagnetic force actuator, for active vibration control, motivated in a dual magnetic manner by a combination of voice-coil-effect and solenoid-effect flux paths, comprising;

an electromagnetic coil structure of magnetically permeable material constructed and arranged to have a typical cross-sectional shape defining at least one prominent pole facing a common reference line at a predetermined spacing distance and separating two of a plurality of adjacent channels formed in the magnetically permeable material each filled with an oppositely polarized coil winding oriented such that wire ends appear in the cross-sectional shape;

a magnet structure having at least one permanent magnet with a pair of magnetically opposed prominent poles of magnetically permeable material having a cross sectional shape such as to face the common reference line from a direction opposite the coil structure, disposed along the common reference line such that the prominent pole(s) of the coil structure and those of the magnet structure are located in a staggered symmetric disposition about the common reference line so as to be mutually centered axially;

suspension means constructed and arranged to retain the coil structure and the magnet structure facing the common reference line at a constant distance therefrom while providing freedom for the electromagnetic coil structure and the magnet structure to vibrate relative to each other in an axial direction along the common reference line:

magnetic flux path conducting means, including magnetically permeable material, for conducting magnetic flux, configured and arranged to conduct portions of magnetic flux paths extending from a first prominent pole of each magnet through a path to a second and opposite prominent pole thereof, the flux paths including (1) a voice-coil-effect flux path that traverses first and second air gaps serially, each gap being made to have substantially constant separation distance under vibration and each containing respectively a central portion of a first and second one of two adjacent ones of said oppositely polarized coil windings, and (2) a solenoid-effect flux path that traverses serially (a) a first air gap containing an end portion of the first coil winding, (b) a prominent pole of the coil structure that is axially movable with respect to the magnet poles, and (c) a second air gap containing an end portion of the second coil winding; the first and second air gaps being constructed and arranged to have respective separation spacings and permeabilities that vary with vibration in a complementary manner;

said actuator being made to have an odd total number of prominent poles and thus to have at least three prominent poles; adjacent magnets being oppositely polarized and adjacent coils being oppositely polarized; and spring means constructed and arranged to provide a spring force tending to establish and maintain the mutually centered relationship between each prominent pole of the coil structure and corresponding prominent poles of the magnet structure;

whereby, in response to alternating current applied to the coil windings, at least one of said structures is caused to vibrate relative to the other, operating in first part according to principles of a voice coil type actuator due to e.m.f. of the voice-coil-effect flux path having substantially constant permeability and acting directly on the said oppositely polarized coil windings as a force in an axial direction, and operating in second part according to principles of a dual-gap solenoid type actuator in the solenoid-effect flux path due to magnetic attraction forces typically between a stator prominent pole and an adjacent movable armature prominent pole, with recurrent complementary flux redistribution in the two air gaps from the complementary variation of respective gap separation distances and permeabilities under vibration.

2. The electromagnetic force actuator as defined in claim 1, wherein said coil structure, constituting a stator assembly, comprises:

a tubular shell, of permeable magnetic material;

a pair of end plates disposed one at each end of said tubular shell:

a quantity of n+1 annular coils, connected alternately in opposite phase polarity relationship, disposed around an inner peripheral region of said shell, each centered axially about a corresponding one of said pole pieces of the armature; and a quantity of n annular stator rings of magnetically permeable material disposed between said coils in an interleaved manner, extending inwardly from said shell so as to constitute the prominent poles of the coil structure;

and wherein said magnet structure, constituting a cylindrical armature assembly disposed coaxially and centrally within said shell, comprises:

a quantity of n identical short cylindrical permanent magnets, each having a pair of parallel magnetically opposite flat pole faces, said magnets, if n>1, being stacked coaxially in alternating polarity directions; and a quantity of n+1 identical short cylindrical armature pole pieces of permeable magnetic material interleaved with said permanent magnets, each adjacent pair of pole pieces flanking and interfacing with pole faces of a corresponding one of said magnets, said pole pieces extending radially outwardly so as to constitute corresponding prominent poles facing the common reference line and forming an annular air gap extending to said shell.

3. The electromagnetic force actuator as defined in claim 2 wherein the stator assembly further comprises an additional pair of said stator rings, disposed at opposite ends of said stator assembly between a corresponding one of said end plates and a corresponding adjacent outermost one of said coils.

4. The electromagnetic force actuator as defined in claim 2 wherein said suspension means comprises a cylindrical support shaft, secured at each end to a corresponding one of the end plates, traversing a cylindrical passageway provided through said armature assembly, made and arranged to allow said armature assembly to vibrate axially.

5. The electromagnetic force actuator as defined in claim 2 wherein said suspension means comprises a cylindrical support shaft, secured concentrically to said armature assembly with two opposite ends each supported slidably by extending through a corresponding one of the end plates, whereby axial vibration of said armature is enabled and whereby such vibration may be transmitted to an external object via an end portion of said support shaft.

6. The electromagnetic force actuator as defined in claim 2 wherein said spring means comprises a pair of coil springs, each disposed between a corresponding end plate and a corresponding outermost one of said armature pole pieces so as to exert a spring force therebetween.

7. The electromagnetic force actuator as defined in claim 1 wherein said suspension means comprises a pair of spring flexure assemblies, each disposed between a corresponding one of the end plates and a corresponding outermost one of said armature pole pieces, each flexure assembly comprising:

at least one pair of flat spring strips crossing each other centrally so as to form a star-shaped pattern with uniformly spaced ends, secured to a corresponding end of said armature assembly such that the ends extend radially from the central axis; and a concentric flexure ring of resilient material constructed and arranged to captivate the extending ends of the star pattern and to be secured against an inner surface of a corresponding end plate, and to thusly support said armature disposed coaxially in said shell and centered between the end plates in a manner that allows said armature assembly to vibrate axially in response to alternating current applied to said coils.

8. The electromagnetic force actuator as defined in claim 7 wherein said suspension means further comprises:

a pair of screw fasteners, one disposed centrally at each end of the armature assembly, traversing a central opening provided in each of said spring strips and threadedly engaging the corresponding end of said armature so as to secure said spring strips to the armature assembly.

9. The electromagnetic force actuator as defined in claim 8 wherein said spring means consist of said spring strips in said suspension means.

10. The electromagnetic force actuator as defined in claim 8 wherein wherein said spring means further comprise:

a pair of coil springs, disposed coaxially at opposite ends of armature assembly so as to exert therefrom a spring force against a corresponding end plate, and said spring strips in said suspension means working in conjunction with said coil springs so as to establish a predetermined spring modulus.

11. The electromagnetic force actuator as defined in claim 6 further comprising an additional pair of stator rings, identical with said stator rings, disposed at opposite ends of said actuator between a corresponding end plate and an adjacent outermost one of said coils.

12. The electromagnetic force actuator as defined in claim 7 wherein each of said spring flexure assemblies is constructed and arranged to have a cross-sectional shape defining (1) a short tubular-shaped portion made to fit against an inwardly-facing surface of a corresponding outermost ring, (2) a first flange, extending radially inwardly from a first edge of the tubular portion, captivating the ends of the spring strips, and (3) a second flange, at a second edge of the tubular portion opposite the first edge, extending radially outwardly for retention between the corresponding outermost ring and the corresponding end plate.

13. The electromagnetic force actuator as defined in claim 12 wherein each of said end plates is configured with an inwardly-facing annular channel dimensioned and located to accommodate and retain the second flange of a corresponding one of said flexure rings.

14. The electromagnetic force actuator as defined in claim 1, wherein said magnet structure, constituting a cylindrical armature assembly, comprises:

a cylindrical permanent magnet having opposite magnetic poles at corresponding opposite flat parallel surfaces; and two identical cylindrical pole pieces of permeable magnetic material, flanking said permanent magnet, configured and arranged to constitute corresponding prominent armature poles facing said shell;

and wherein said magnetic coil structure, constituting a stator assembly, comprises:

a tubular shell, of permeable magnetic material, a pair of end plates disposed one at each end of said shell and attached thereto;

two annular coils, connected in opposite phase polarity relationship, disposed around an inner peripheral region of said shell; and a stator ring of magnetically permeable material, disposed centrally between said two coils, extending radially inward from said shell so as to constitute a prominent pole of the magnetic coil structure;

suspension means for supporting the armature assembly in said shell with positive coaxial constraint and with spring-loaded axial constraint arranged to establish a central quiescent axial armature location at which the two armature pole pieces straddle said stator ring symmetrically and about which the armature can be driven, by alternating current applied to said coils, so as to vibrate axially against the spring-loaded axial constraint.

15. The electromagnetic force actuator as defined in claim 14 wherein the stator assembly further comprises an additional pair of said stator rings, disposed at opposite ends of said stator assembly, each retained between a corresponding one of said end plates and a corresponding one of said coils.

16. The electromagnetic force actuator as defined in claim 1, wherein:

said magnet structure is incorporated in a stator assembly comprising:

a tubular shell, of non-magnetic material, including a pair of end plates disposed one at each end thereof;

a quantity of n annular-shaped permanent magnets located peripherally inside said shell, each having two opposed parallel faces defining magnetic poles of opposite polarity, stacked adjacently with alternating polarity so that poles of like polarity face each other; and a quantity of n+1 annular-shaped stator rings of magnetically permeable material disposed between said magnets in an interleaved manner, extending inwardly from said shell past said magnets so as to constitute the prominent poles of the magnet structure;

and wherein said coil structure is incorporated in a cylindrical armature assembly, surrounded coaxially by said stator assembly, comprising:

a generally cylindrical central core of magnetically permeable material configured and arranged to define a row of n+1 adjacent annular-shaped coil winding bobbin channels interleaved with cylindrical prominent pole pieces extending radially outward from said core and facing said shell; and a quantity of n+1 identical annular coils, connected alternately in opposite phase polarity relationship, disposed each in a corresponding one of said bobbin channels and each centered axially about a corresponding one of said stator rings.

17. The electromagnetic force actuator as defined in claim 1 wherein said suspension means comprises a pair of spring flexure assemblies, each disposed between a corresponding one of the end plates and a corresponding outermost one of said armature pole pieces, each flexure assembly comprising:

at least one flat spring strip, secured centrally to a corresponding end of said armature assembly such that two opposite ends thereof extend radially from the central axis; and a concentric flexure ring of resilient material constructed and arranged to captivate the extending ends and to be secured against an inner surface of a corresponding end plate, and to thusly support said armature disposed coaxially in said shell and centered between the end plates in a manner that allows said armature assembly to vibrate axially in response to alternating current applied to said coils.

* * * * *

UNITED STATES PATENT AND TRADEMARK OFFICE

CERTIFICATE OF CORRECTION

PATENT NO. : 5,896,076
DATED : April 20, 1999
INVENTOR(S) : Van Namen

It is certified that error appears in the above-identified patent and that said Letters Patent is hereby corrected as shown below:

Title page,
Item [73], insert the following: -- [73] Assignee: Motran Industries, Inc, Valencia, CA --

Signed and Sealed this

Sixteenth Day of July, 2002

*Attest:*

*Attesting Officer*

JAMES E. ROGAN
*Director of the United States Patent and Trademark Office*